US009121229B2

(12) United States Patent
Gallagher

(10) Patent No.: US 9,121,229 B2
(45) Date of Patent: Sep. 1, 2015

(54) MERLIN DRILLING RISER ASSEMBLY

(71) Applicant: Oil States Industries (UK) Ltd., Aberdeen (GB)

(72) Inventor: John Gallagher, Aberdeen (GB)

(73) Assignee: OIL STATES INDUSTRIES (UK) LTD., Aberdeen (GB)

( * ) Notice: Subject to any disclaimer, the term of this patent is extended or adjusted under 35 U.S.C. 154(b) by 0 days.

(21) Appl. No.: 14/268,651

(22) Filed: May 2, 2014

(65) Prior Publication Data

US 2014/0326502 A1 Nov. 6, 2014

Related U.S. Application Data

(60) Provisional application No. 61/819,273, filed on May 3, 2013.

(51) Int. Cl.

| | |
|---|---|
| ***E21B 17/01*** | (2006.01) |
| ***E21B 17/08*** | (2006.01) |
| ***E21B 17/18*** | (2006.01) |

(52) U.S. Cl.

CPC ..... *E21B 17/01* (2013.01); *E21B 17/085* (2013.01); *E21B 17/18* (2013.01)

(58) Field of Classification Search

None

See application file for complete search history.

(56) References Cited

U.S. PATENT DOCUMENTS

| | | | | |
|---|---|---|---|---|
| 2,102,072 A | | 12/1937 | Hinderliter | |
| 4,043,575 A | * | 8/1977 | Roth | 285/90 |
| 4,265,470 A | | 5/1981 | Danner | |
| 4,496,173 A | * | 1/1985 | Roche et al. | 285/24 |
| 8,056,940 B2 | | 11/2011 | Morgan et al. | |
| 8,474,540 B2 | * | 7/2013 | Guesnon et al. | 166/367 |

FOREIGN PATENT DOCUMENTS

| | | |
|---|---|---|
| GB | 2033518 | 5/1980 |
| GB | 1573945 | 8/1980 |
| GB | 2099529 | 12/1982 |
| GB | 2113335 | 8/1983 |
| GB | 2138089 | 10/1984 |
| WO | WO 2007/127394 | 11/2007 |

OTHER PUBLICATIONS

Oil States Industries(UK) LTD; Merlin Advanced Connection System for Deepwater Applications; Catalog; UK.

(Continued)

*Primary Examiner* — Matthew Buck
*Assistant Examiner* — Douglas S Wood
(74) *Attorney, Agent, or Firm* — Morgan, Lewis & Bockius LLP

(57) ABSTRACT

An improved drilling riser assembly including a male drilling riser assembly section and a female drilling riser assembly section that form a connection joint when mated. The drilling riser assembly sections having an internal stab type main drilling riser connector. The drilling riser assembly sections each have main drilling riser flanges that have helically threaded rings on an outer edge of the flange. A box and pin connector each have an inner helically threaded ring that mates with the outer helical flange ring of a drilling riser assembly section. The box and pin connectors extend towards each other and make up an enclosed compression joined mating section around the stab type connectors of the drilling riser assembly.

14 Claims, 12 Drawing Sheets

(56) References Cited

OTHER PUBLICATIONS

Oil States Industries (UK) LTD; High Pressure Composite Riser Systems; Catalog; UK.

Oil States Industries (UK) LTD; Riser & Drilling Products High Pressure (HP) Drilling Riser System; 2012; Catalog; UK.

PCT/IB2014/001724: International Search Report and Written Opinion; Apr. 16, 2015.

* cited by examiner

MERLIN DRILLING RISER ASSEMBLY

RELATED APPLICATIONS

The present application claims the benefit of U.S. Provisional Patent Application, Ser. No. 61/819,273 filed on May 3, 2013, incorporated herein by reference in its entirety.

BACKGROUND

1. Field of the Invention

The present invention relates to subsea drilling riser assemblies.

2. Description of the Related Art

Marine drilling riser assemblies have seen use in drilling operations for some time. In subsea drilling it is useful to re-use piping and pipe connectors at the drill site when possible. This can be useful when, for example, the subsea assembly needs to be brought back onto the drilling rig for re-working and then returned into service. Over time drilling operations have seen drilling to greater water depths, causing drilling assemblies to experience increasingly greater pressures while undergoing increasingly greater tension forces associated with longer and deeper subsea installations. These factors and others continue to create the need for more advanced marine drilling riser assemblies that can withstand these increased forces.

Subsea drilling operations have traditionally been based on marine drilling riser assemblies having flange type connectors with heavy bolts or stab type connectors with locking dogs to connect pipe sections. Often a box and pin including either an external flange type connector or stab type connector are welded to the ends of a pipe section. Once mated, matching ends of a flange type connector system are then be bolted together to secure the connection joint. These types of connections can include both multi-riser and single-riser configurations. It would be desirable to have connection joints that can undergo greater subsea pressures, handle increased tension loads, have greater re-usability, and install relatively quickly. These characteristics would additionally allow for greater drilling depths and less man hours per installation.

Additionally, it would be desirable to have marine drilling riser assemblies that include some of the characteristics of the Merlin type pipe connectors. Merlin type pipe connectors are well known in the art for connecting pipes together and are disclosed in GB1573945, GB2033518, GB2099529, GB2113335 and GB2138089. For a Merlin type connector, the connection is formed by a tubular pin member having a frustoconical outer peripheral surface and a tubular box member having a generally frustoconical inner peripheral surface corresponding to the frustoconical outer peripheral surface of the pin member. In use, the two members, each associated with a pipe section are telescoped together and are axially locked together by mating annular projections and grooves provided on the said peripheral surfaces, the projections and grooves being spaced apart along the two surfaces.

In telescoping the two members together, they are initially telescoped until surface contact is made between crest surfaces of the projections and surfaces between the grooves at least at the ends of the overlapped portions of the surfaces. Hydraulic fluid under pressure is then typically supplied between the overlapped parts of the surfaces to expand the box member and/or contract the pin member to permit the members to be fully telescoped together or the members may simply be pushed together. Pressurized hydraulic fluid is also used to disengage the members by expanding the box member and/or contracting the pin member to bring the projections out of engagement with the corresponding grooves.

SUMMARY OF THE INVENTION

The present invention provides a subsea drilling assembly that can undergo greater subsea pressures, handle increased tension loads, has greater re-usability, and can install relatively quickly when compared to previous designs. The improved drilling riser assembly includes both multi-riser and single-riser embodiments.

In accordance with the present invention, an improved drilling riser assembly includes a male drilling riser assembly section and a female drilling riser assembly section. The male drilling riser assembly section has an internal stab type main drilling riser connector optionally surrounded by stab type choke, kill, booster, and service connectors. The male drilling riser assembly section includes a main drilling riser flange and has a helically threaded ring on the outer edge of the flange. A Merlin style box connector has an inner helically threaded ring, mates with the outer helical flange ring, and extends around the stab type connectors of the male drilling riser assembly section.

The female drilling riser assembly section has an internal stab type main drilling riser connector for mating with the stab type drilling connector of the male drilling riser assembly section. The female drilling riser assembly section can optionally be surrounded by stab type choke, kill, booster, and service connectors. The female drilling riser assembly section includes a main drilling riser flange and has a helically threaded ring on the outer edge of the flange. A Merlin style pin connector has an inner helically threaded ring, mates with the outer helical flange ring, and extends around the stab type connectors of the male drilling riser assembly section.

The Merlin style box connector further includes a frustoconical inner peripheral surface and the Merlin style pin connector further includes a frustoconical outer peripheral surface, the frustoconical surfaces configured to mate together. The frustoconical inner surface of the Merlin style box connector has inter-engageable annular projections and grooves for axially locking with inter-engageable annular projections and groves of the frustoconical outer surface of the Merlin style pin connector.

When configured for installation the Merlin style box connector helical thread ring is mated with the helical thread ring of the flange thereby connection the Merlin style box connector to a pipe section. Likewise, the Merlin style pin connector helical thread ring is mated with the helical thread ring of the flange installed on a separate pipe section. With each Merlin style connector mounted to a pipe section the connectors can be joined by compressing the two sections together. This joins the Merlin style box and pin connectors, the internal stab type main drilling riser connectors, and any of the optional choke, kill, booster, or service lines.

BRIEF DESCRIPTION OF THE DRAWINGS

Various aspects and attendant advantages of one or more exemplary embodiments and modifications thereto will become more readily appreciated as the same becomes better understood by reference to the following detailed description, when taken in conjunction with the accompanying drawings, wherein.

DETAILED DESCRIPTION

Figure 1:
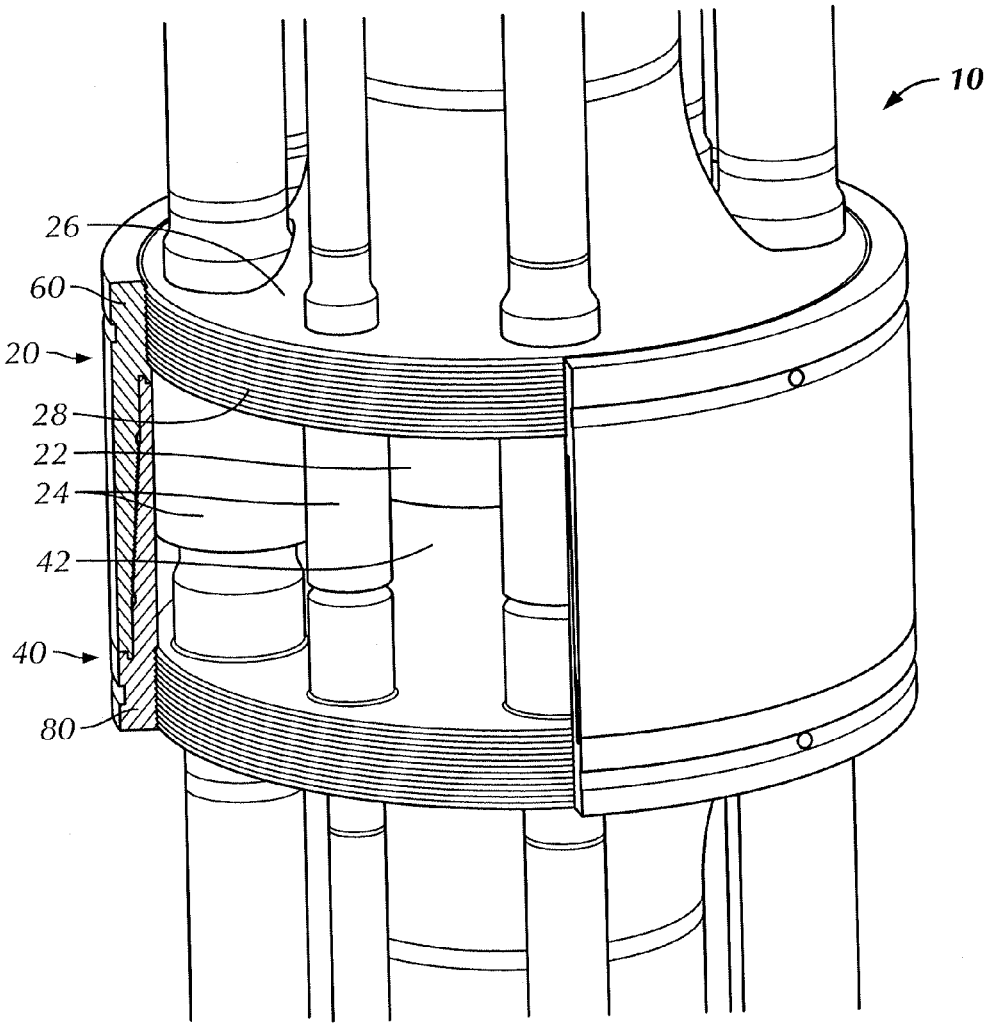
FIG. 1 is a side elevational view including a cutaway of an exemplary drilling riser assembly.

Exemplary embodiments are illustrated in referenced Figures of the drawings. It is intended that the embodiments and Figures disclosed herein are to be considered illustrative rather than restrictive. No limitation on the scope of the technology that follows is to be imputed to the examples shown in the drawings and discussed herein.

Referring to FIG. 1, the present invention provides an improved subsea drilling assembly 10 that can undergo greater subsea pressures, handle increased tension loads, has greater re-usability, and can install relatively quickly when compared to previous designs. In accordance with the present invention, the improved drilling riser assembly 10 includes a male drilling riser assembly section 20 and a female drilling riser assembly section 40.

Referring to FIGS. 1, 2, 3, and 4, the male drilling riser assembly section 20 has an internal stab type main drilling riser connector 22 and may optionally be surrounded by one or more stab type choke, kill, booster, and service connectors 24. The male drilling riser assembly section 20 includes a main drilling riser flange 26 having a helically threaded ring 28 on the outer edge of the flange.

Figure 2:
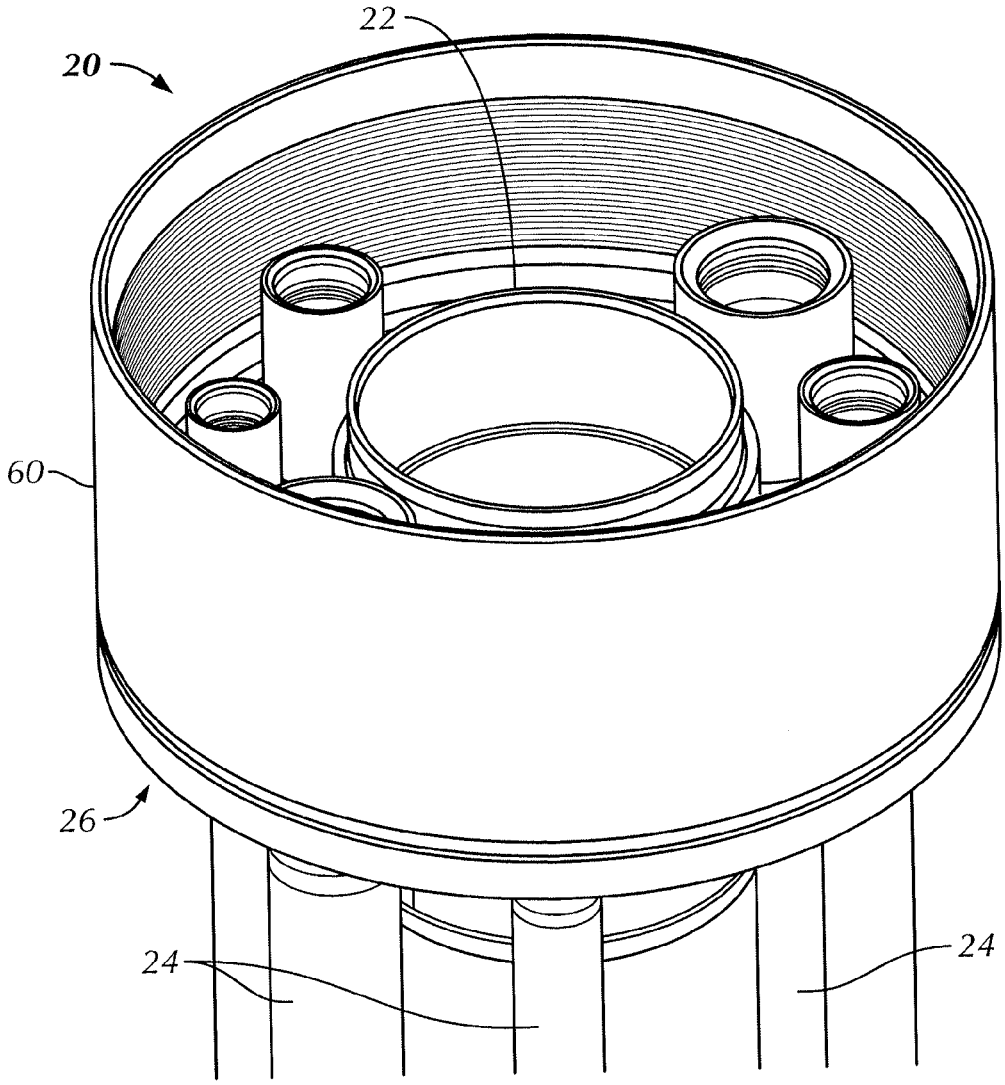
FIG. 2 is a side elevational view of a male drilling assembly riser section.
Figure 3:
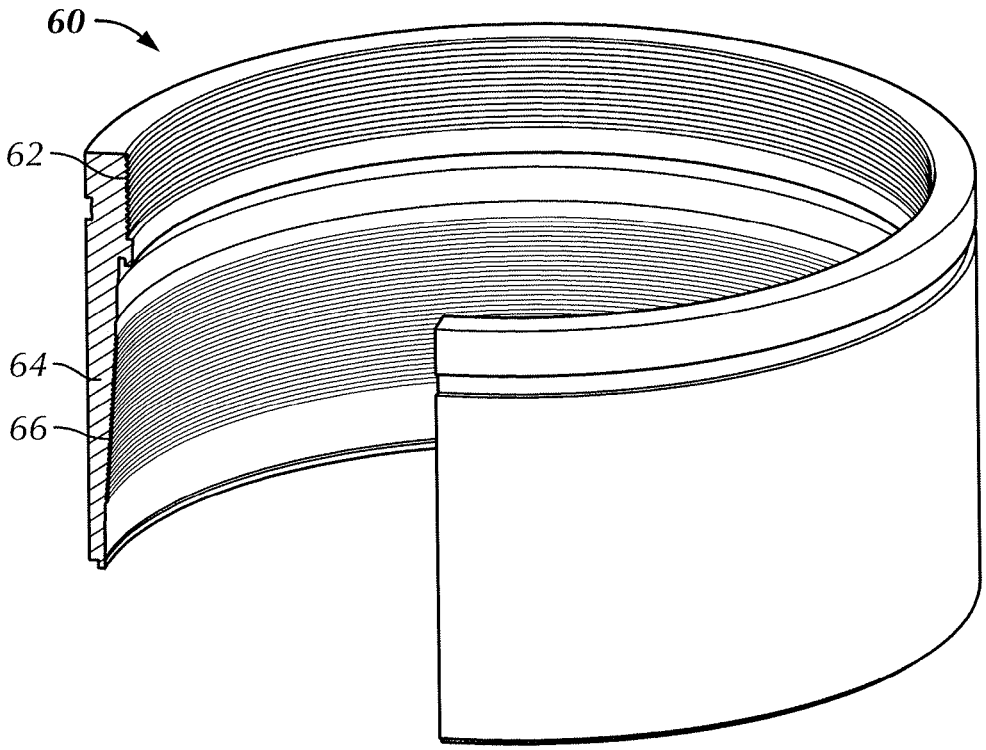
FIG. 3 is a side elevational view of a Merlin style box connector showing an inner helically threaded ring.
Figure 4:
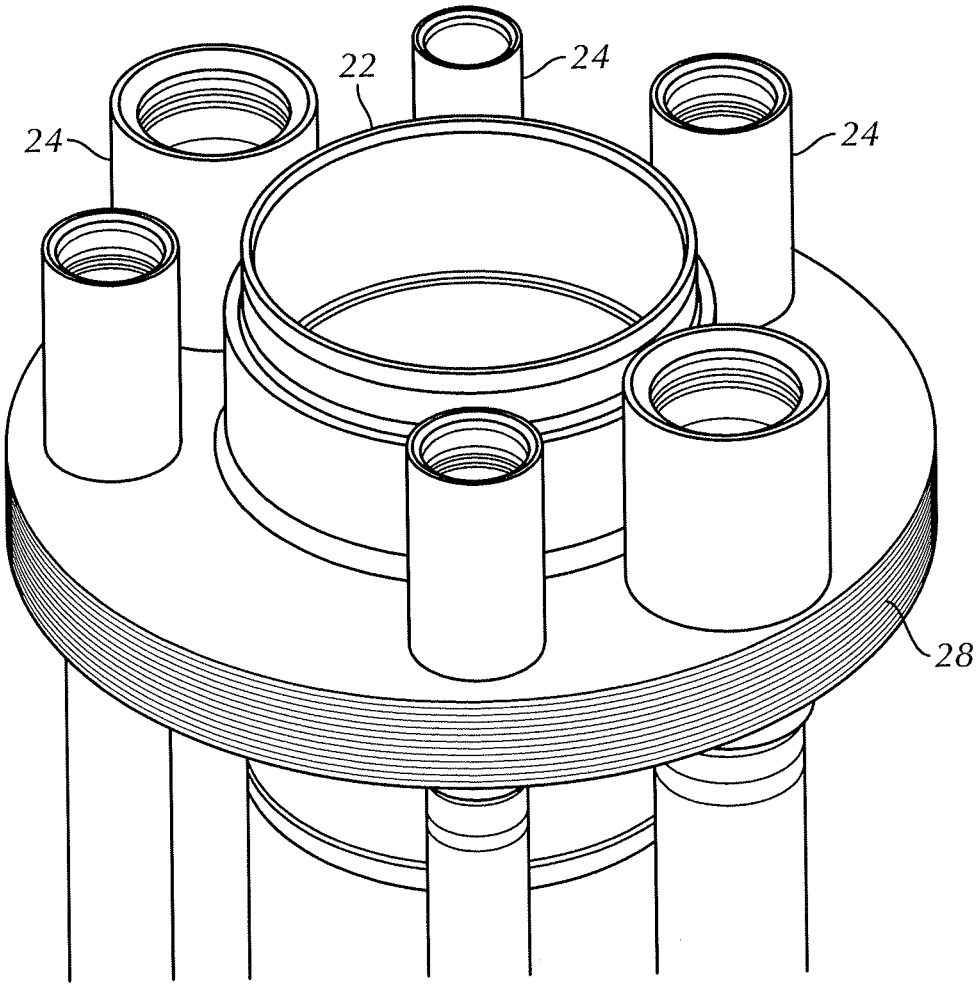
FIG. 4 is a side elevational view of a male drilling assembly riser section flange with the Merlin style box connector removed.
Figure 5:
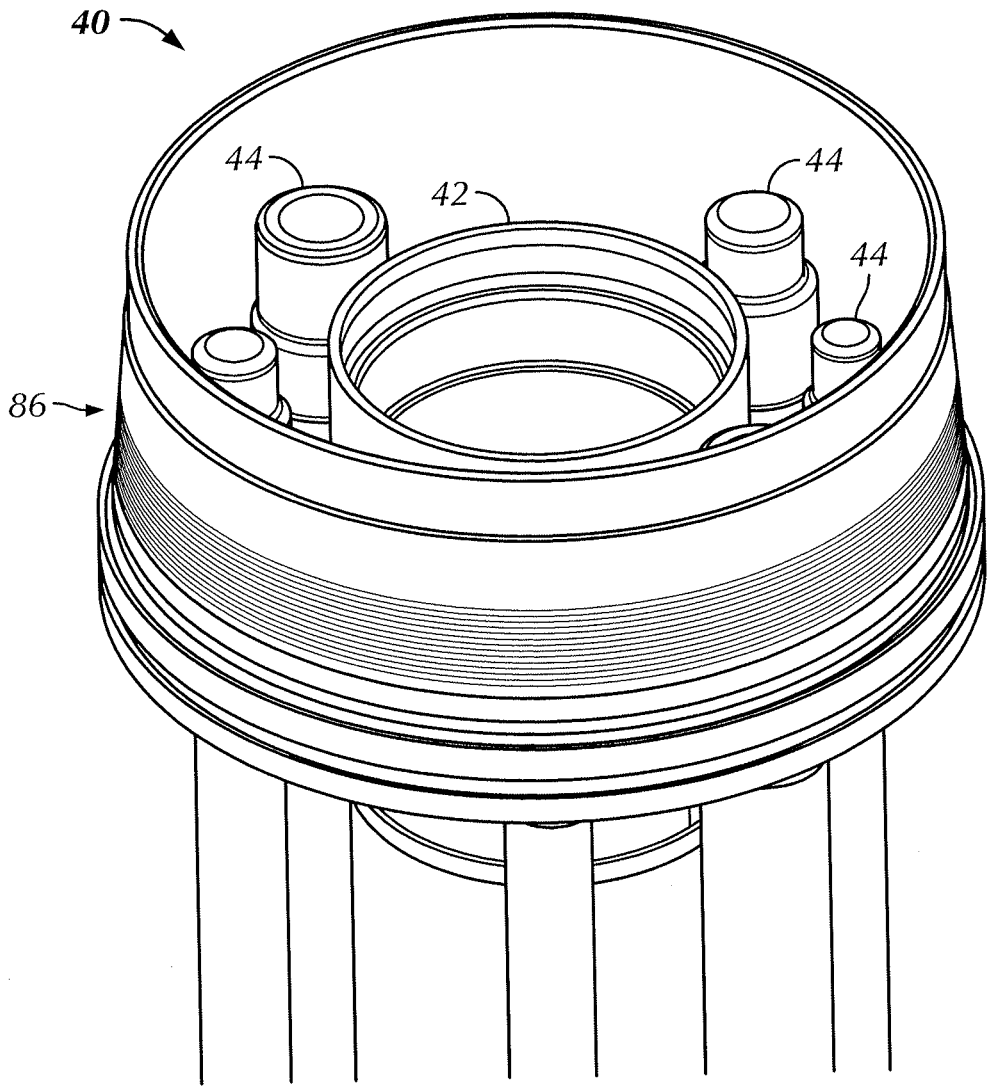
FIG. 5 is a side elevational view of a female drilling assembly riser section in accordance with the present invention.
Figure 6:
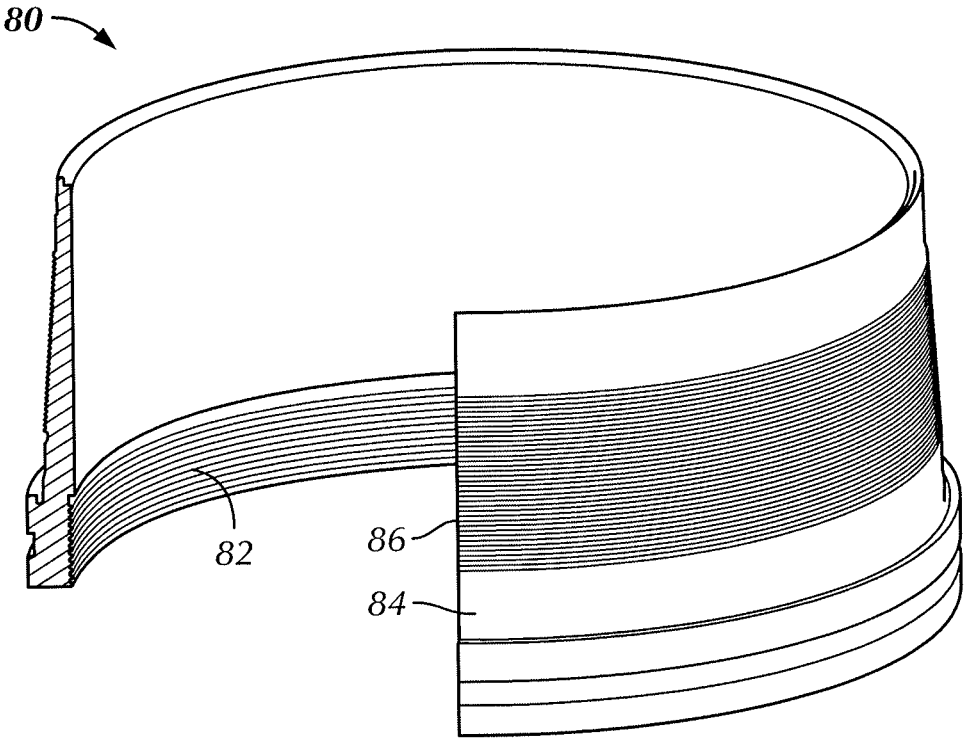
FIG. 6 is a side elevational view of a Merlin style pin connector showing an outer helically threaded ring.
Figure 7:
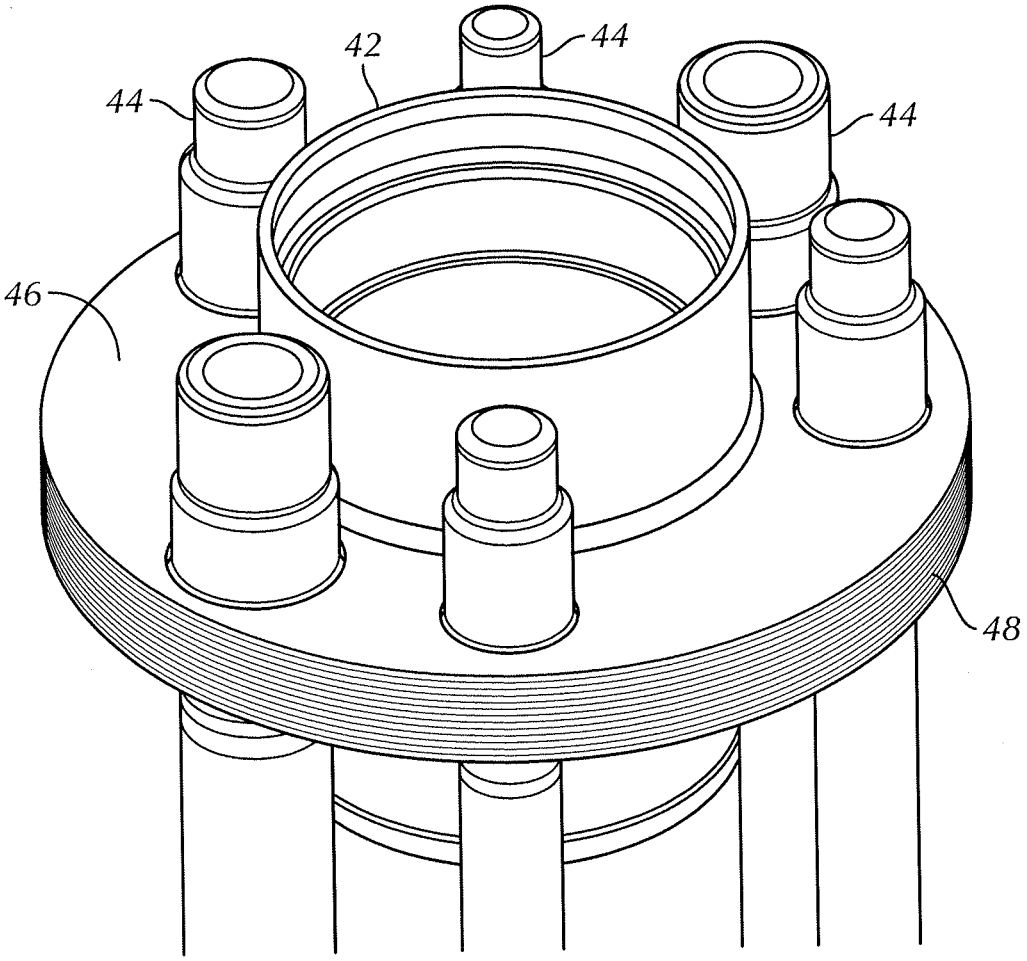
FIG. 7 is a side elevational view of a female drilling assembly riser section flange with the Merlin style pin connector removed.
Figure 8A:
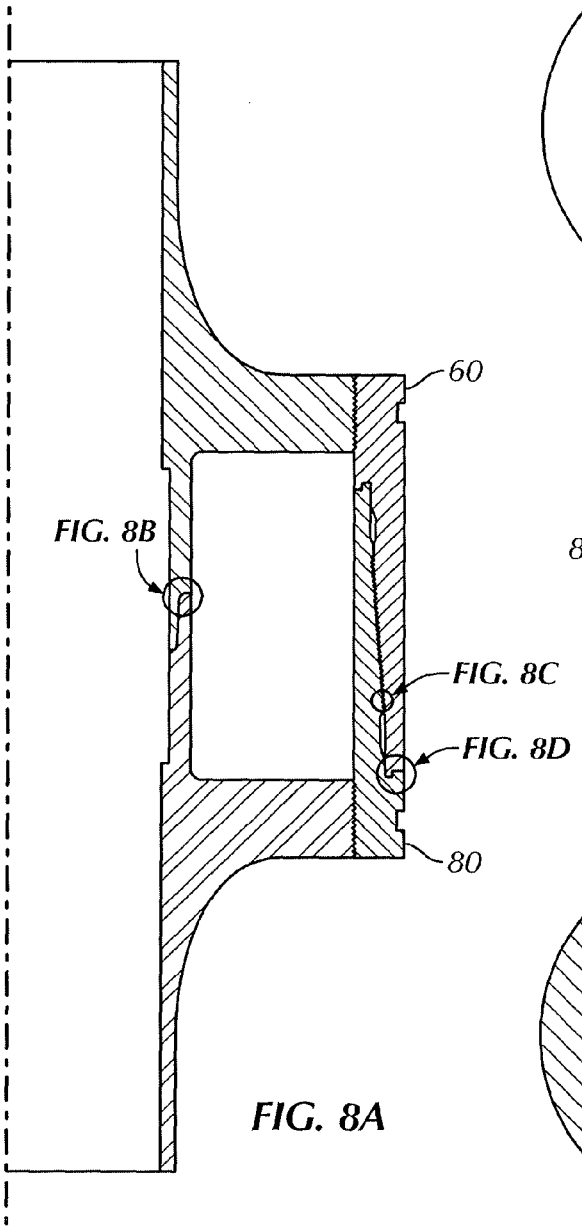
FIG. 8A is a side cross sectional view of a Merlin style drilling riser assembly just prior to being fully assembled.
Figure 8B:
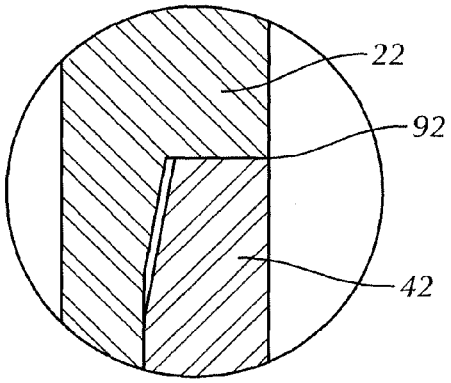
FIG. 8B is an enlarged section of the side cross sectional view of the Merlin style drilling riser assembly of FIG. 8A.
Figure 8C:
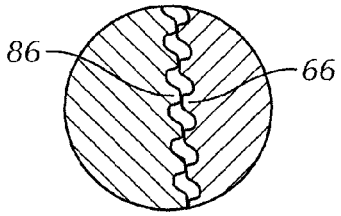
FIG. 8C is an enlarged section of the side cross sectional view of the Merlin style drilling riser assembly of FIG. 8A.
Figure 8D:
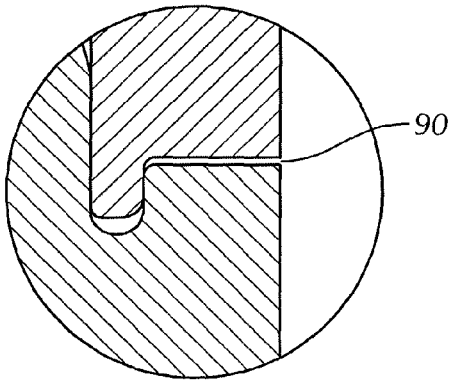
FIG. 8D is an enlarged section of the side cross sectional view of the Merlin style drilling riser assembly of FIG. 8A.
Figure 9A:
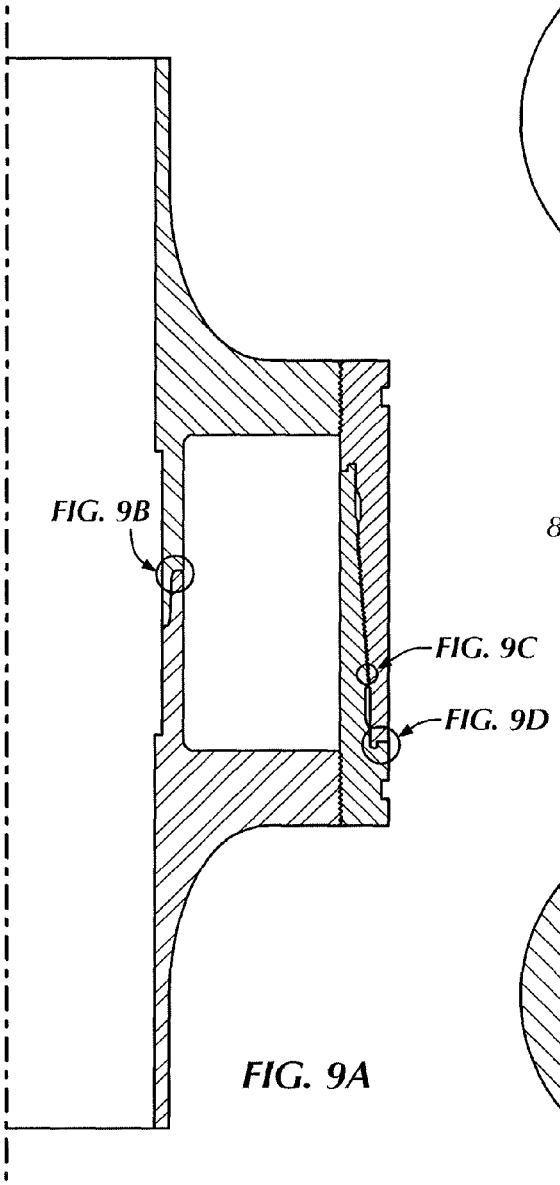
FIG. 9A is a side cross sectional view of a Merlin style drilling riser assembly immediately after being fully assembled.
Figure 9B:
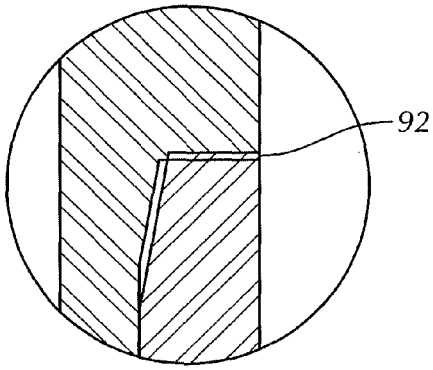
FIG. 9B is an enlarged section of the side cross sectional view of the Merlin style drilling riser assembly of FIG. 9A.
Figure 9C:
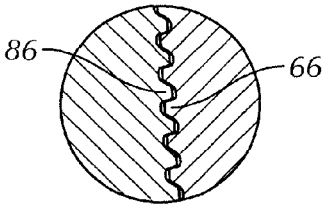
FIG. 9C is an enlarged section of the side cross sectional view of the Merlin style drilling riser assembly of FIG. 9A.
Figure 9D:
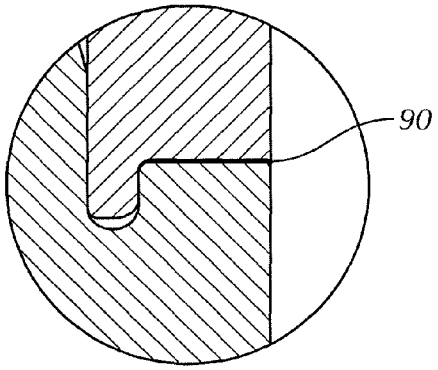
FIG. 9D is an enlarged section of the side cross sectional view of the Merlin style drilling riser assembly of FIG. 9A.
Figure 10:
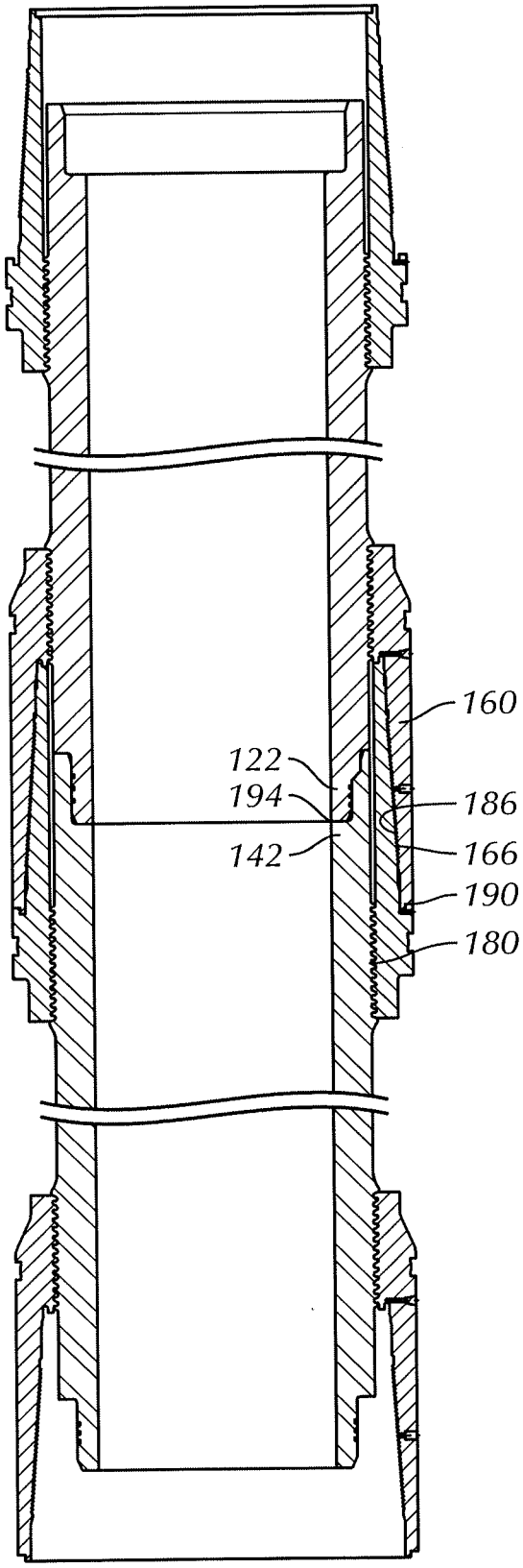
FIG. 10 is a cross-sectional view of a single-riser Merlin style drilling riser assembly.
Figure 11A:
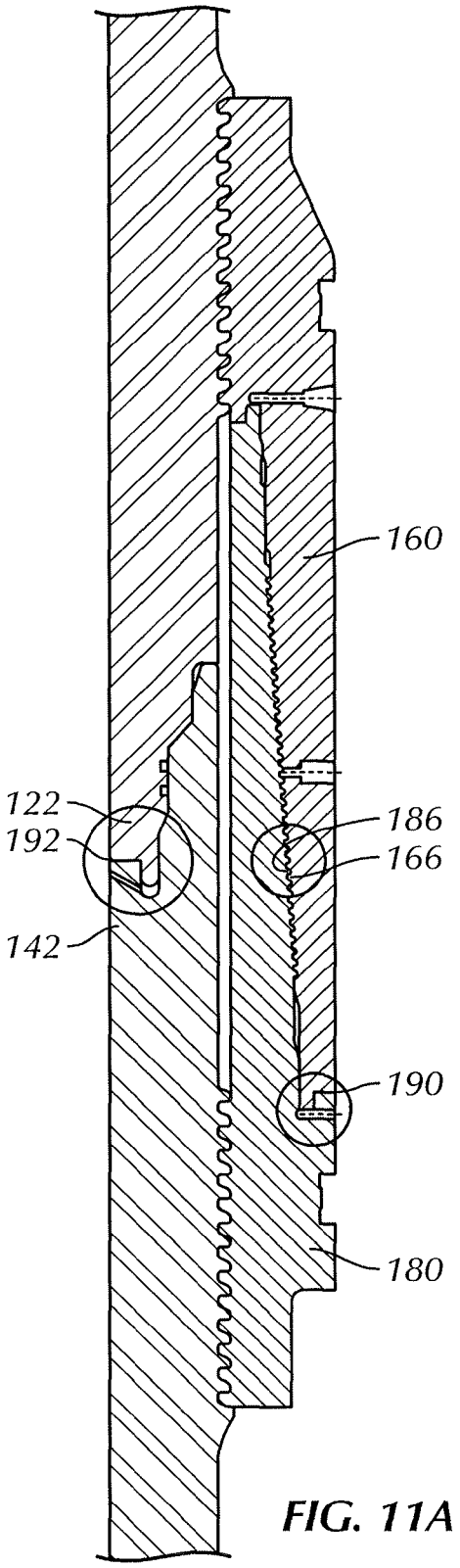
FIG. 11A is a side cross-sectional view of a section of an alternate embodiment of the connection joint of the single-riser Merlin style drilling riser assembly of FIG. 10.
Figure 11B:
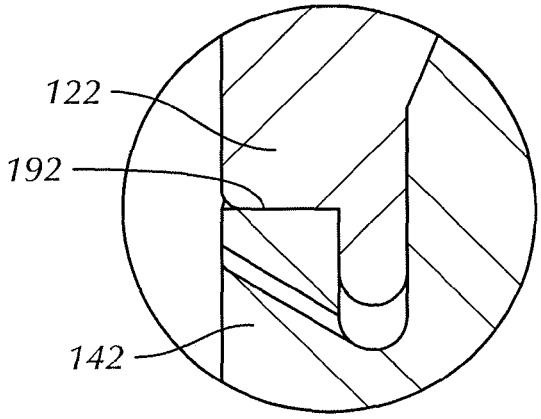
FIG. 11B is an enlarged section of the side cross-sectional view of a section of the connection joint of the single-riser Merlin style drilling riser assembly of FIG. 11A.
Figure 11C:
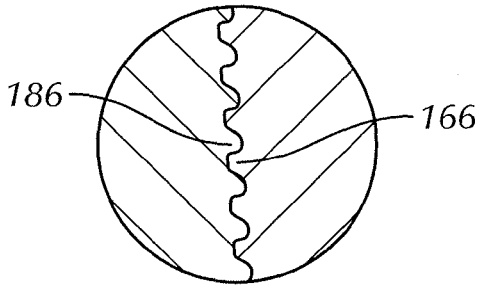
FIG. 11C is an enlarged section of the side cross-sectional view of a section of the connection joint of the single-riser Merlin style drilling riser assembly of FIG. 11A.
Figure 11D:
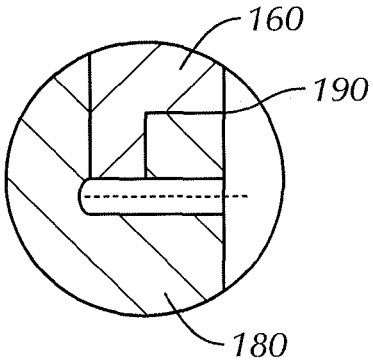
FIG. 11D is an enlarged section of the side cross-sectional view of a section of the connection joint of the single-riser Merlin style drilling riser assembly of FIG. 11A.
Figure 12A:
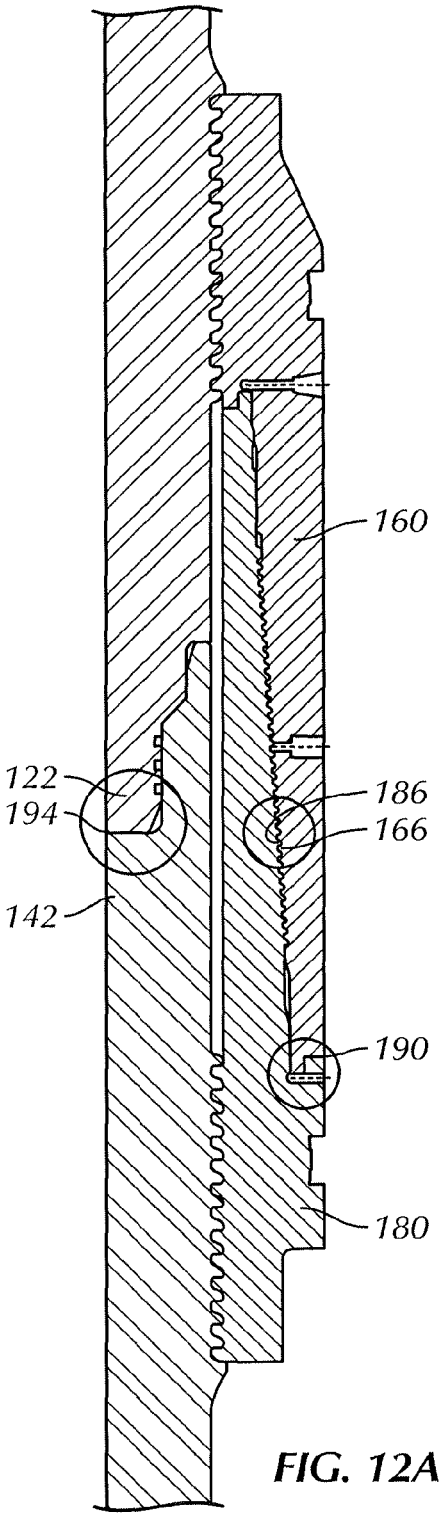
FIG. 12A is a side cross-sectional view of the connection joint of the single-riser Merlin style drilling riser assembly of FIG. 10.
Figure 12B:
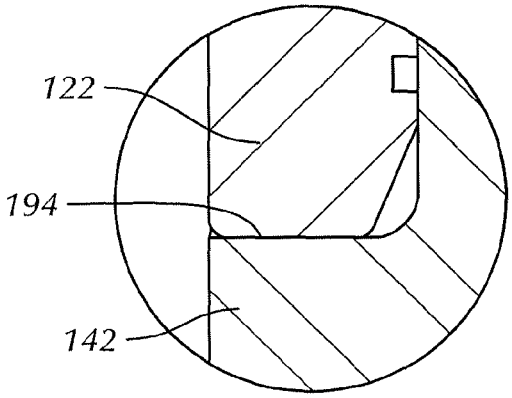
FIG. 12B is an enlarged section of the side cross-sectional view of a section of the connection joint of the single-riser Merlin style drilling riser assembly of FIG. 12A.
Figure 12C:
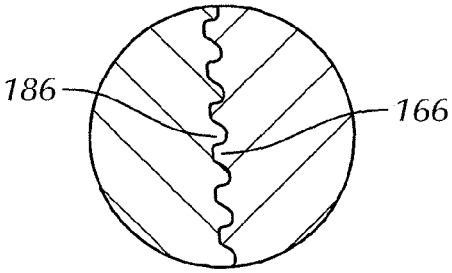
FIG. 12C is an enlarged section of the side cross-sectional view of a section of the connection joint of the single-riser Merlin style drilling riser assembly of FIG. 12A.
Figure 12D:
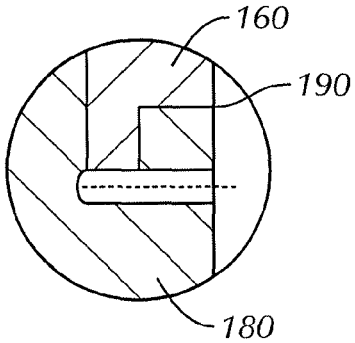
FIG. 12D is an enlarged section of the side cross-sectional view of a section of the connection joint of the single-riser Merlin style drilling riser assembly of FIG. 12A.

In an embodiment, a Merlin style box connector 60 has an inner helically threaded ring 62 (as shown in FIG. 2) and mates with the outer helical flange ring 28. The helical threaded ring 28 of the flange and the helical threaded ring 62 of the box connector 60 allow for easier and quicker installation of the drilling riser assembly as a whole, especially when compared to previous connection designs such as the bolt and flange design. In an embodiment, the Merlin style box connector 60 can extend around the stab type connectors 24 of the male drilling riser assembly section 20.

Referring to FIGS. 1, 5, 6, and 7, the female drilling riser assembly section 40 having an internal stab type main drilling riser connector 42 for mating with the stab type drilling connector of the male drilling riser assembly section (as shown in FIGS. 1, 2, 3, and 4). The female drilling riser assembly section 40 may optionally be surrounded by stab type choke, kill, booster, and service connectors 44. The female drilling riser assembly section 40 includes a main drilling riser flange 46 having a helically threaded ring 48 on the outer edge of the flange.

In an embodiment, a Merlin style pin connector 80 having an inner helically threaded ring 82 mates with the outer helical flange ring (as shown in FIG. 1) and extends around the stab type connectors 24 of the male drilling riser assembly section 20.

Referring again to FIGS. 1, 2, 3, and 4, the Merlin style box connector 60 further includes a frustoconical inner peripheral surface 64 and the Merlin style pin connector 80 further includes a frustoconical outer peripheral surface 84, the frustoconical surfaces of the box and pin are configured to mate together when compression pushes the pieces together. The frustoconical inner surface of the Merlin style box connector 60 has inter-engageable annular projections and grooves 66 for axially locking with inter-engageable annular projections and grooves 86 of the frustoconical outer surface 82 of the Merlin style pin connector 80.

When configured for installation the Merlin style box connector helical thread ring is mated with the helical thread ring of the flange thereby connection the Merlin style box connector to a pipe section. Likewise, the Merlin style pin connector helical thread ring is mated with the helical thread ring of the flange installed on a separate pipe section. With each Merlin style connector mounted to a pipe section the connectors can be joined by compressing the two sections together. This joins the Merlin style box and pin connectors, the internal stab type main drilling riser connectors, and any of the optional choke, kill, booster, or service lines.

In an embodiment, the Merlin style box connector 60 can be configured with the female drilling riser assembly section 40 and the Merlin style pin connector can be configured with the male drilling riser assembly section 20. Similarly, the male and female ends of the stab type connectors 24 can each be configured with either the male or female drilling riser assembly sections.

Some of the benefits of the new drilling assembly include the ability to swap out the Merlin style box and pin connectors when they become damaged or when different levels of axial preload are required. The swaps can be faster and more cost effective for a long drill string as welding is not required. The Merlin style box and pin connectors also allow for higher strength and thinner pipe to be used which generally provides a lighter weight riser. This can be particularly advantageous when dealing with long drill strings offshore. The Merlin style box and pin connectors are particularly advantageous for use in sour service environments where the standard dictates that the hardness of the pipe, connector, and/or weld material does not exceed 250 Hv10 (22 HRC) at the internal surface or 275 Hv10 (26HRC) at the outer surface. In the event that the material hardness exceeds these levels, then special material testing would need to be performed to simulate exposure to high concentrations of $H_2S$ while under high stress levels. For high pressure operations, it is beneficial to use the highest strength material available, which allows minimized required wall thickness, which in turn allows for a lower weight of pipe, as mentioned previously. The Merlin connector allows for increased pipe strength, minimized wall thickness, and lower weight pipe, among other advantages. The connector also allows for each of these criteria to be met for use in $H_2S$ and other sour service environments.

As illustrated in FIGS. 8A-8D and 9A-9D, changes to the Merlin style box and pin section inner and outer helical portions can provide custom levels of axial preload within the connector. This allows the level of preload in the connector to be tailored to suit the precise operating conditions including water depth, environmental loads and assembly tooling capacity. Preload within the connector is determined when the connector components are manufactured. Referring to FIGS. 8A-8D, during assembly, an inner abutment interface 92 between the drilling riser main connectors 22 and 42 closes prior to an external abutment interface 90 between the Merlin pin 80 and the Merlin box 60. As additional external axial force is applied to close the external abutment interface 90, axial preload is built up between the main drilling riser connectors 22 and 42. By varying the distance at the abutment interface 90 relative to abutment interface 92, the level of preload can be closely controlled and will not be dependent on any action by the riser installation crew at the time of assembly. Prior to full assembly a set of Merlin pin inter-engageable annular projections and grooves ("Merlin pin teeth") 86 and Merlin box inter-engageable annular projections and grooves ("Merlin box teeth") 66 are not fully engaged and will have contact at the crests of the teeth only.

Referring to FIGS. 9A-9D, when sufficient external axial force has been applied, and abutment interface 90 closes, Merlin pin teeth 86 and Merlin Box teeth 66 will be properly aligned to provide a robust axial connection. The resulting preload at the abutment interface 92 will represent a combination of elastic axial shortening of the drilling riser main connectors 22 and the drilling riser connectors 42, resulting in elastic axial lengthening of the Merlin pin 80 and Merlin box 60 and elastic deformation.

Referring to FIGS. 10, 11A-11D, and 12A-12D, various embodiments of a single riser drilling riser assembly having the Merlin connector are shown. During assembly, an inner abutment interface 194 between the drilling riser main connectors 122 and 142 closes prior to an external abutment interface 190 between the Merlin pin 180 and the Merlin box 160. Referring to FIGS. 11A-11D, an alternate embodiment of an abutment interface 192 is shown. As additional external axial force is applied to close the external abutment interface 190, axial preload is built up between the main drilling riser connectors 122 and 142. By varying the distance at the abutment interface 190 relative to abutment interface 192, the level of preload can be closely controlled and will not be dependent on any action by the riser installation crew at the time of assembly. Prior to full assembly a set of Merlin pin inter-engageable annular projections and grooves ("Merlin pin teeth") 186 and Merlin box inter-engageable annular projections and grooves ("Merlin box teeth") 166 are not fully engaged and will have contact at the crests of the teeth only.

Although the concepts disclosed herein have been described in connection with the preferred form of practicing them and modifications thereto, those of ordinary skill in the art will understand that many other modifications can be made thereto. Accordingly, it is not intended that the scope of these concepts in any way be limited by the above description.

The invention claimed is:

1. A drilling riser assembly for subsea well installations, the drilling riser assembly comprising:

a male drilling riser assembly section, comprising:

an internal stab type male main drilling riser connector, a main drilling riser flange having a helically threaded ring on the outer edge of the flange, and a box connector having an inner helically threaded ring configured to mate with the helically threaded ring on the outer edge of the flange and having a set of inward facing inter-engageable annular projections and grooves; and a female drilling riser assembly section, comprising:

an internal stab type female main drilling riser connector, a main drilling riser flange having a helically threaded ring on the outer edge of the flange, and a pin connector having an inner helically threaded ring configured to mate with the helically threaded ring on the outer edge of the flange and having a set of outward facing inter-engageable annular projections and grooves configured to engage with the inward facing inter-engageable annular projections and grooves of the male drilling riser assembly section box connector.

2. The drilling riser assembly of claim 1, wherein the drilling riser assembly includes a section of pipe having a helically threaded ring on each end to facilitate the connection with a male drilling riser assembly section and a female drilling riser assembly section respectively.

3. The drilling riser assembly of claim 1, wherein the main drilling riser flange extends outwardly from the central axis and the helically threaded ring on the outer edge of the main drilling riser flange is axially spaced apart from the internal stab type connector.

4. The drilling riser assembly of claim 3, wherein the portion of the main drilling riser flange that extends outwardly has one or more axial passages to accommodate a multiple riser assembly.

5. A drilling riser assembly for subsea well installations, the drilling riser assembly comprising:

a male drilling riser assembly section, comprising:

an internal stab type male main drilling riser connector, a main drilling riser flange having a helically threaded ring on the outer edge of the flange, and a pin connector having an inner helically threaded ring configured to mate with the helically threaded ring on the outer edge of the flange and having a set of outward facing inter-engageable annular projections and grooves; and a female drilling riser assembly section, comprising:

an internal stab type female main drilling riser connector, a main drilling riser flange having a helically threaded ring on the outer edge of the flange, and a box connector having an inner helically threaded ring configured to mate with the helically threaded ring on the outer edge of the flange and having a set of inward facing inter-engageable annular projections and grooves configured to engage with the inward facing inter-engageable annular projections and grooves of the male drilling riser assembly section box connector.

6. The drilling riser assembly of claim 5, wherein the drilling riser assembly additionally comprises a section of pipe having a helically threaded ring on each end to facilitate the connection with a male drilling riser assembly section and a female drilling riser assembly section respectively.

7. The drilling riser assembly of claim 5, wherein the main drilling riser flange extends outwardly from the central axis and the helically threaded ring on the outer edge of the main drilling riser flange is axially spaced apart from the internal stab type connector.

8. The drilling riser assembly of claim 7, wherein the portion of the main drilling riser flange that extends outwardly additionally comprises one or more axial passages to accommodate a multiple riser assembly.

9. A method of deploying a drillstring for subsea well installations, wherein the steps comprise:

configuring a drilling riser pipe section, wherein the steps comprise:

attaching a male drilling riser assembly section to a section of pipe, thereby configuring at least a portion of the drilling riser pipe section, the male drilling riser assembly section comprising:

an internal stab type male main drilling riser connector, a main drilling riser flange having a helically threaded ring on the outer edge of the flange, and a pin connector having an inner helically threaded ring configured to mate with the helically threaded ring on the outer edge of the flange and having a set of outward facing inter-engageable annular projections and grooves; and attaching a female drilling riser assembly section to a section of pipe, thereby configuring at least a portion of the drilling riser pipe section, the female drilling riser assembly section comprising:

an internal stab type female main drilling riser connector, a main drilling riser flange having a helically threaded ring on the outer edge of the flange, and a box connector having an inner helically threaded ring configured to mate with the helically threaded ring on the outer edge of the flange and having a set of inward facing inter-engageable annular projections and grooves configured to engage with the inward facing inter-engageable annular projections and grooves of the male drilling riser assembly section box connector;

mating a configured drilling riser pipe section to an uppermost portion of a drillstring at an offshore wellsite.

10. The method of claim 9, wherein the drilling riser pipe section additionally comprises a section of pipe having a helically threaded ring on each end to facilitate the connection with a male drilling riser assembly section and a female drilling riser assembly section respectively.

11. The method of claim 9, wherein the main drilling riser flange extends outwardly from the central axis and the helically threaded ring on the outer edge of the main drilling riser flange is axially spaced apart from the internal stab type connector.

12. The method of claim 11, wherein the portion of the main drilling riser flange that extends outwardly additionally comprises one or more axial passages to accommodate a multiple riser assembly.

13. The method of claim 12, wherein the steps further comprise:

configuring one or more pipe sections that are a part of the one or more multiple riser assembly strings in the one or more axial passages of the configured drilling riser pipe section.

14. The method of claim 9, wherein the steps further comprise:

applying sufficient axial force to the drilling riser pipe section such that an abutment interface between the drilling riser pipe section and the uppermost portion of the drillstring substantially closes.

* * * * *